US005683331A

United States Patent [19]

Dalebout

[11] Patent Number: 5,683,331

[45] Date of Patent: Nov. 4, 1997

[54] STEP EXERCISE BENCH WITH RATCHETING HEIGHT ADJUSTMENT

[75] Inventor: William T. Dalebout, Logan, Utah

[73] Assignee: ICON Health & Fitness, Inc., Logan, Utah

[21] Appl. No.: 360,562

[22] Filed: Dec. 21, 1994

Related U.S. Application Data

[63] Continuation-in-part of Ser. No. 29,529, Oct. 7, 1994, Pat. No. Des. 371,176.

[51] Int. Cl.[6] ..... A63B 21/00

[52] U.S. Cl. ..... 482/52; 482/51; 248/421; 248/422; 297/423.45

[58] Field of Search ..... 482/51, 52, 908, 482/142; 297/261, 439, 461, 462, 423.45, 334.12, 334.15; 108/6, 11, 12, 18, 19, 106; 248/188.2, 422, 669

[56] References Cited

U.S. PATENT DOCUMENTS

| | | | |
|---|---|---|---|
| 44,438 | 9/1864 | McBride et al. | 108/6 |
| D. 287,283 | 12/1986 | Johnson . | |
| D. 299,501 | 1/1989 | Howze . | |
| D. 300,045 | 2/1989 | Grider . | |
| D. 323,537 | 1/1992 | Wilkinson . | |
| D. 327,718 | 7/1992 | Kofler . | |
| D. 330,057 | 10/1992 | Saunders et al. . | |
| D. 330,234 | 10/1992 | Saunders et al. . | |
| D. 332,647 | 1/1993 | Johnson . | |
| D. 333,329 | 2/1993 | Jacobs . | |
| D. 337,362 | 7/1993 | Goldstein et al. . | |
| D. 339,179 | 9/1993 | Wilkinson . | |
| D. 346,189 | 4/1994 | Chen . | |
| 789,813 | 5/1905 | Longley | 297/261 |
| 3,859,930 | 1/1975 | Sherwin | 108/6 |
| 3,940,181 | 2/1976 | Cheek, Jr. | 297/261 |
| 4,340,218 | 7/1982 | Wilkinson . | |
| 4,561,652 | 12/1985 | Wilkinson . | |
| 4,648,593 | 3/1987 | Wilkinson . | |
| 4,659,075 | 4/1987 | Wilkinson . | |
| 4,984,785 | 1/1991 | Wilkinson . | |
| 4,993,706 | 2/1991 | Wilkinson . | |
| 5,037,084 | 8/1991 | Flor . | |
| 5,050,861 | 9/1991 | Thomas et al. . | |
| 5,066,001 | 11/1991 | Wilkinson . | |
| 5,096,186 | 3/1992 | Wilkinson et al. . | |
| 5,108,089 | 4/1992 | Wilkinson . | |
| 5,116,044 | 5/1992 | Wilkinson et al. . | |

(List continued on next page.)

OTHER PUBLICATIONS

Packaging for "Stepshaper Step By Step Workout Video"—Weslo, Inc. —1993.

Packaging for "Stepshaper Stepping Up Workout Video"—Weslo, Inc. —1994.

Packaging for "Stepshaper Step Funk Workout Video"—Weslo, Inc. —1994.

Advertisement for "Bench Step Aerobic System"—J C Penney Catalog—p. 740 —1994.

Advertisement for Reebok Step Platform from Club Industry Magazine dated 1995.

Advertisement for Step II appearing in Winter 1995 Home Fitness Buyers Guide.

Advertisement for Jane Fonda Stepper appearing in Jane Fonda's Personal Training Guide no date.

Official gazzet No. 174125 claims 1–4 and Figs 1–3 Dec. 26, 1916 Loren A Jewell.

*Primary Examiner*—Jerome Donnelly

*Attorney, Agent, or Firm*—Trask, Britt & Rossa

[57] ABSTRACT

A step exercise bench includes a platform and has ratcheting support members providing for adjustment of the height of the platform. The platform has opposite ends with a pawl mounted proximate thereto. A pair of pivotally connected support members are disposed below the platform between the ends. Each support member has ratchet steps formed thereon. The pawls selectively engage ratchet steps. The support members have floor members extending below the ratchet means, for resting on a support surface such as a floor. Springs urge the pawls into selected steps formed in the support members.

34 Claims, 6 Drawing Sheets

U.S. PATENT DOCUMENTS 5,118,095 6/1992 Flor .
5,118,096 6/1992 Wilkinson et al. .
5,125,646 6/1992 Wilkinson .
5,127,647 7/1992 Wilkinson .
5,154,678 10/1992 Adamczyk et al. .
5,162,028 11/1992 Wilkinson .
5,169,360 12/1992 Saunders ..... 482/52
5,176,596 1/1993 Ullman .
5,213,554 5/1993 Goldstein et al. .
5,248,286 9/1993 Wilkinson et al. .
5,275,579 1/1994 Wilkinson .
5,328,427 7/1994 Sleamaker .

STEP EXERCISE BENCH WITH RATCHETING HEIGHT ADJUSTMENT

RELATED APPLICATIONS

This application is a continuation-in-part of U.S. patent application Ser. No. 29/029,529, filed Oct. 7, 1994, now U.S. Pat. No. Des. 371,176 which issued on Jun. 25, 1996.

BACKGROUND OF THE INVENTION

1. Field of the Invention

The invention relates to exercise equipment and particularly concerns benches for aerobic step exercising.

2. State of the Art

A low bench for use in performing repetitive stepping up and down exercises is known. The difficulty of the stepping exercise and the degree of conditioning attained varies with the height of the step and the length of the exercise periods or sessions, as well as with the rate of stepping (e.g., steps per minute) and the frequency of exercise (e.g., number of exercise periods or sessions per week).

Desirably, the height of a bench for step exercises should be adjustable to allow a user to vary the difficulty of the exercise either during a particular session, or over a series of sessions. The height adjustment mechanism should be reliable and easy to operate. Also desirably, the bench should be lightweight and portable so that it is easily carried, for example within the home or from home to class. The bench should, nevertheless, be of sturdy and durable construction to withstand the repetitive stepping and weight of a human exerciser.

Numerous exercise step benches are known, as exemplified by U.S. Pat. Nos. 5,275,579, 5,118,096, 5,116,044, 5,096,186, and 5,066,001 all to Wilkinson et al., U.S. Pat. No. 5,037,084 to Flor, U.S. Pat. No. 5,154,678 to Adamczyk, U.S. Pat. No. 5,176,596 to Ullman, U.S. Pat. No. 5,213,554 to Goldstein et al., and U.S. Pat. No. 5,050,861 to Thomas et al. However, most of these benches have disadvantages. Many have a height adjustment mechanism requiring that the bench be partially inverted to move the support members to another orientation. Such a mechanism is inconvenient to adjust in a fast-paced exercise session. Others may involve some assembly to vary the height. Related loose pieces may readily be misplaced or broken. Some known benches also do not provide a sufficient range of height adjustment.

Accordingly, a need remains for an improved adjustable-height platform for repetitive stepping exercise. Desirably, such a bench or platform is light weight and has a unitary construction and a support system which provides rapid and simple adjustment of height.

SUMMARY

A stepping bench has a platform with a first flange connected thereto or formed as a part thereof to extend downwardly therefrom. A second flange spaced apart from the first flange is connected to or formed as a part of the platform to extend downwardly therefrom. A support structure is connected to the platform to extend downwardly between the pair of spaced apart flanges. A first support member has a proximal end rotatably attached to the support structure. It also has a distal end which is movable between a first position and a second position relative to the platform. First securing means is mechanically associated with the first flange for selectively securing the first support member in the first position and the second position. A second support member is also rotatably attached to the support structure. The second support member has a distal end movable between the first position and the second position relative to the platform. The second securing means is mechanically associated with the second flange for selectively securing the second support member in its respective first position and second position.

In a preferred configuration, first securing means includes a first mechanical member moveable relative to the first flange and a first receiving structure associated with the distal end of the first support member to receive the first mechanical member. In a preferred arrangement, the first mechanical member is a first pawl adapted to the first flange and the receiving structure is a plurality of ratchet steps sized and formed to sequentially connect with the first pawl in the first position and in the second position of the respective first support member. Desirably the second securing means includes a mechanical member moveable relative to the first flange and a second receiving structure associated with the distal end of the second support member to receive the second mechanical member. Most preferably, the second mechanical member is also a pawl with the second receiving structure also preferably a plurality of ratchet steps sized and formed to sequentially connect with said second pawl in the respective first position and second position of the second support member.

In an alternate configuration, the first mechanical member may include a pin and the receiving structure is a plurality of spaced apart apertures formed in the distal end. The pin is operable by the user to register with the spaced apart apertures to secure the support member in its respective first position and second position. Preferably the pin has a knob on the end for grasping by the user. Also desirably a spring is associated with the pin to urge the pin toward the spaced apart apertures.

In an alternate embodiment, the first pawl has means associated therewith for operation by the user and spring means for urging the first pawl toward the distal end of the first support member, and more specifically, a selected ratchet step.

In an alternate arrangement, the support structure includes a pivot member to which the first support member and the second support member are each rotatably secured. In yet a further embodiment, the step bench includes a cover member connected to the platform and shaped to extend over the first mechanical member. In yet a further embodiment, the step bench includes a cushioning mat positioned on the upward surface of the platform.

In yet another configuration, a step exercise bench includes a platform with a ratcheting support means for adjustment of the height of the platform. The platform has flanges depending from near each end, and pawl means mounted on the flanges. A pair of support members are disposed below the platform between the flanges in inverse orientation relative to each other, and are pivotingly connected at their respective proximal ends. The distal ends of the support members have respective ratchet means formed thereon in outward orientation, with the ratchet means being ratchetingly engaged with the respective adjacent pawl means. The support members may further include foot supports extending below the ratchet means for resting on a support surface such as a floor.

BRIEF DESCRIPTION OF THE DRAWINGS

In the drawings, which depict the best mode presently known for carrying out the invention.

DETAILED DESCRIPTION OF THE ILLUSTRATED EMBODIMENT

Figure 1:
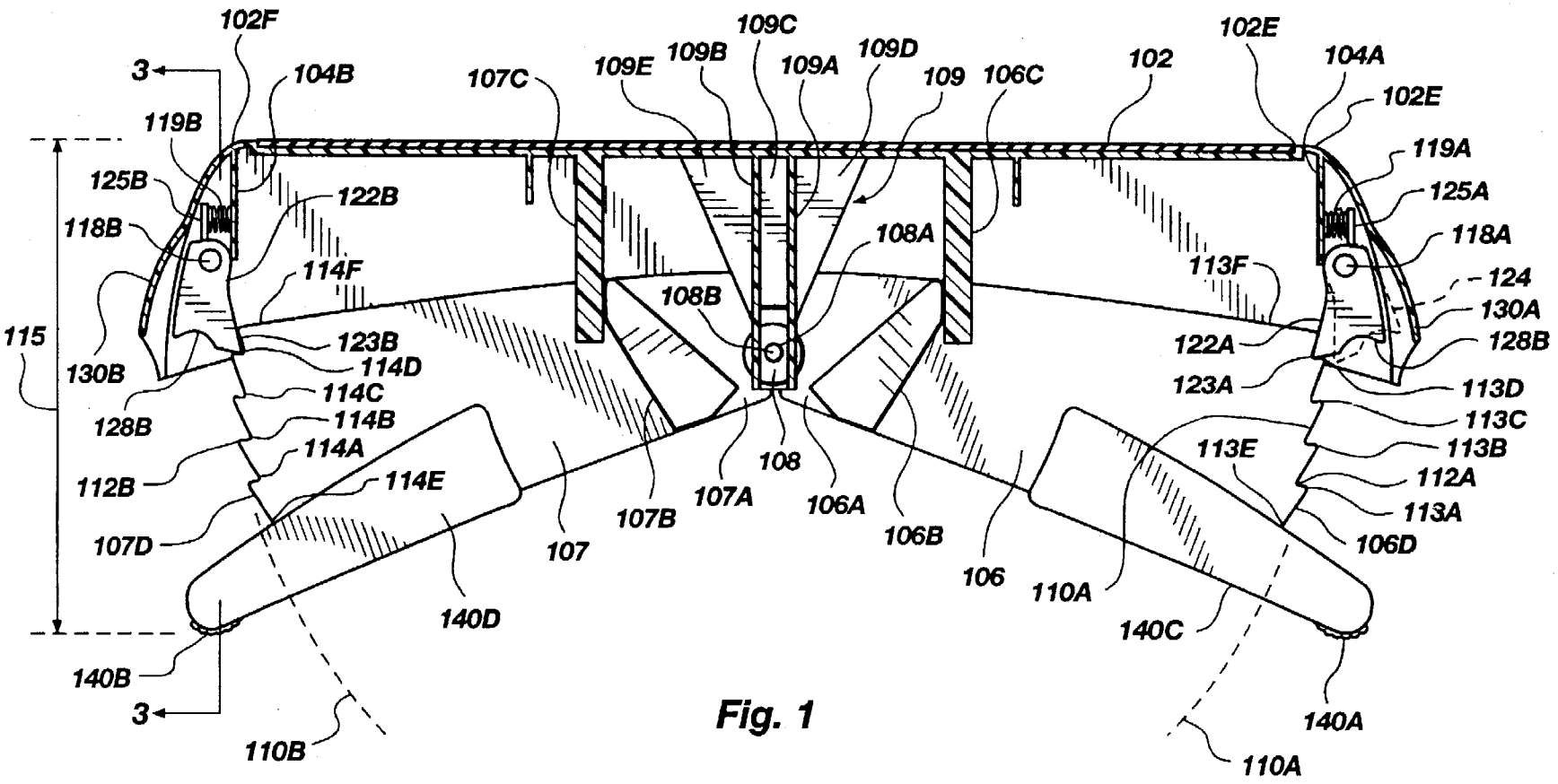
FIG. 1 is a plan view of the step bench in the elevated configuration.

As seen in FIG. 1, a step exercise bench 100 has a platform 102 with flanges 104A and 104B depending from proximate both ends. A pair of support members 106 and 107 are each disposed below the platform 102 and between the flanges 104A and 104B. Support members 106 and 107 are positioned opposite to each other, and are pivotingly connected at their respective proximal ends 106A and 107A to support structure 109 which includes axle or pivot 108. Support members 106 and 107 each have a foot support 140C and 140D and a ratchet arc 110 with a plurality of teeth 112 formed thereon.

Figure 2:
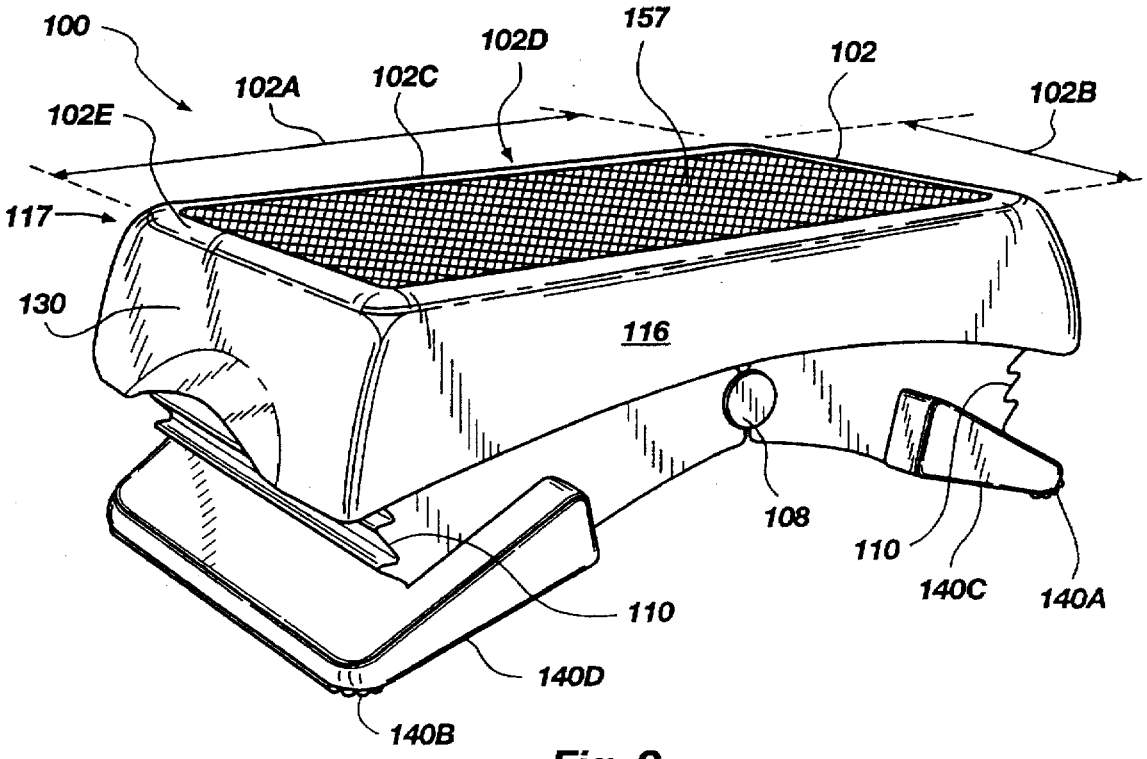
FIG. 2 is a perspective view of a step bench of the invention in an elevated configuration.

In FIG. 2, the platform 102 is shown to be generally rectilinear in shape with a length 102A and a width 102B selected to provide a large stepping surface for the user. In the illustrated embodiment, the length 102A is about 2 feet and the width 102B is about 14½ inches. The platform 102 presents a flat stepping surface. However other shapes or forms of stepping surfaces may be desired including a slightly concave or dished surface having an outer perimeter 102C elevated relative to the center portion 102D. Also the platform 102 may be made in shapes other than rectilinear including an oval shape.

The platform 102 is preferably formed from a sturdy plastic material. However it may be made of any desired metal, wood or plastic which has sufficient strength to support a user performing stepping exercises. The support structure 109 of FIG. 1 is shown to have a pair of spaced apart walls 109A and 109B reinforced by one or more internal transverse members 109C and one or more triangular supports 109D and 109E. The pivot 108 is formed as an aperture 108A with a pin 108B rotatably positioned therethrough. Other configurations of a support structure 109 and a pivot 108 may be used to provide the bench 100 with the necessary structural rigidity and strength and a position for rotation of the support members 106 and 107.

FIG. 1 also shows cams 106B and 107B positioned to contact cam posts 106C and 107C. The cams 106B and 107B abut the posts 106C and 107C to limit outward movement of the support members 106 and 107.

The spaced apart flanges 104A and 104B of FIG. 1 are here shown extending downwardly from the platform 102 at the outer ends 102E and 102F. Although the flanges 104A and 104B are here shown at the ends 102E and 102F, they may be positioned inwardly from the outer ends 102E and 102F. The flanges 104A and 104B may be separated, attached or connected to the platform 102 by any convenient mechanical arrangement. In the illustrated embodiment, the flanges 104B and 104A are of plastic and are unitarily formed with the platform 102.

Offset pins 118A and 118B are mounted to flanges 104A and 104B, respectively. Pawl members 122A and 122B are pivotally mounted to the respective offset pins 118A and 118B. Pawl members 122A and 122B each have a ratchet-engaging portion 123A and 123B configured to engage the ratchet steps or teeth 112A and 112B formed in the distal ends 106D and 107D of the support members 106 and 107 to constitute the ratchet arcs 110A and 110B.

As noted the support members 106 and 107 each rotate about the pivot 108. The respective distal ends 106B and 107B are here shaped so that the steps or teeth 112A and 112B are positioned along arcs which have been designated as the ratchet arcs 110A and 110B. In FIG. 1, each ratchet arc 110A and 110B has four (4) teeth or steps 113A–D and 114A–D. Each tooth or step 113A–D and 114A–D equates to a separate height 115 adjustment for the platform 102. That is, each support member 106 and 107 is moveable between a first position established by engagement of the respective pawl 122A and 122B with one step 113A and 114A and a second position established by engagement of the respective pawl 122A and 122B with another step 113B and 114B. Of course, the illustrated embodiment illustrates the availability of six positions or heights 115 by selection of the desired tooth or step 113A–F and 114A–F. It should be understood that more or fewer teeth or steps 113 and 114 may be used as desired. Notably one support member 106 can be set at one height 115 and the other support member 107 at a different height 115. Thus the platform 102 may be made substantially level if positioned on an uneven surface; or the platform 102 may be tilted to one side or the other as desired by a user.

Figure 4:
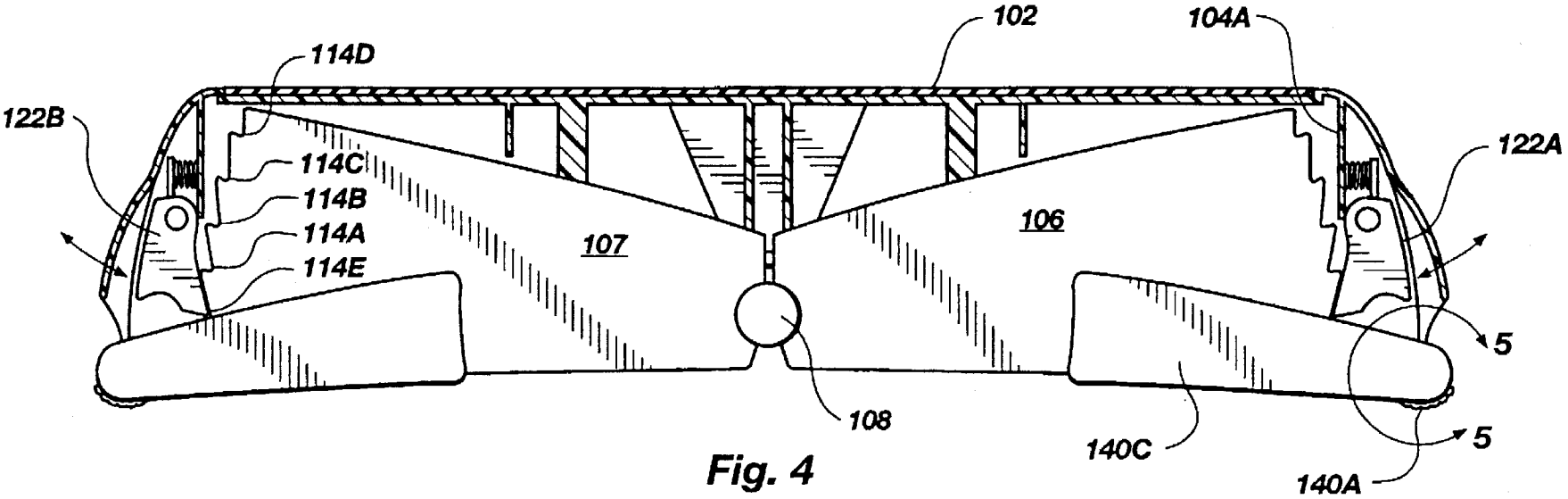
FIG. 4 is a plan view of the step bench in a collapsed configuration.

The pawls 122A and 122B move toward the support members 106 and 107 to engage a selected tooth or step 113A–D and 114A–D; and they pivot outward from the flanges 104A and 104B, as indicated by the dashed silhouette 124. When in the position 124, the ratchet-engaging portion 123A is out of the ratchet arc 110 (FIG. 1) and the support members 106 and 107 are free to rotate to other positions about the pivot 108. (See FIG. 4).

The pivot 108 may be configured as a rod which extends from proximate side 116 to proximate the side 117 of the bench 100. The pivot 108 may also be two separate short pins, one connecting the two support members on the one side 116 and the other connecting the two support members on the other side 117.

In FIG. 1, the offset pins 118A and 118B are secured to the flanges 116A and 104B. The pawls 122A and 122B rotate about the pins 118A and 118B and are tensioned by springs 119A and 119B to urge the pawl 122A and 122B against a selected ratchet step or tooth 113A–D and 114A–D. The springs 119A and 119B act against the flanges 104A and 104B and against spring plates 125A and 125B. The springs 119A and 119B shown are coil springs held in place by grooves formed in the flanges 104A and 104B and in spring plates 125A and 125B. Other springs such as leaf springs may be used. A clock spring may also be mounted to the offset pins 118A and 118B.

Figure 3:
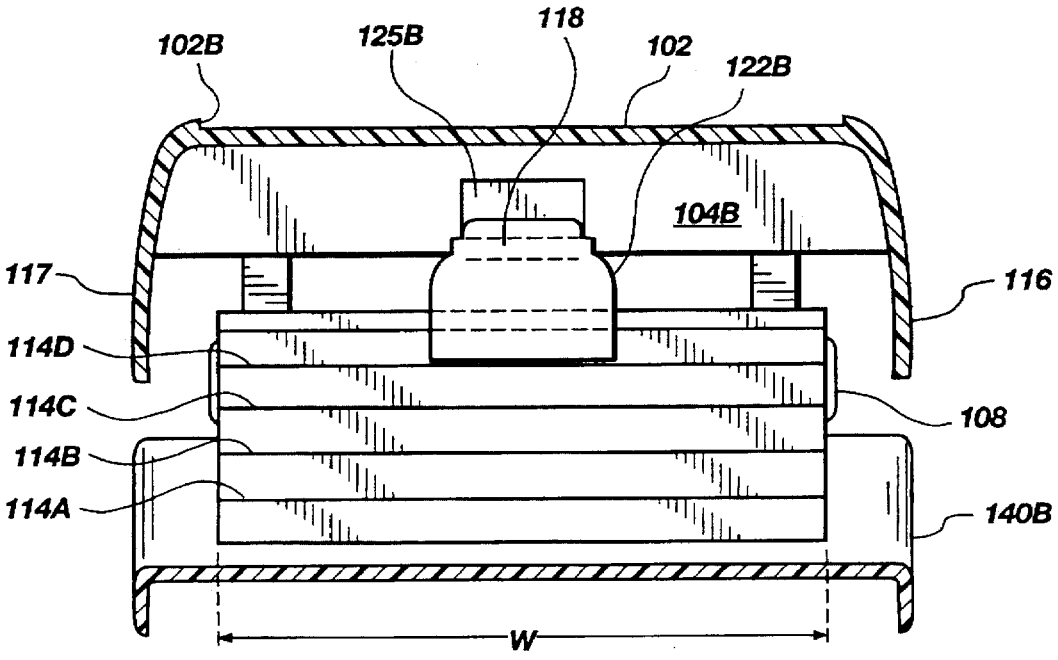
FIG. 3 is a plan view of the step bench in the elevated configuration as seen from either end.

As seen in FIGS. 1–3, the ratchet arc 110 is preferably configured as shown. The support members 106 and 107 have width W somewhat less than that of the platform 102, and the teeth or steps 112 extend the entirety of the width W.

Desirably, pawls 122A and 122B each have a curved indent 128A and 128B sized to receive a user's fingers. In turn, the user may urge the pawls 122A and 122B outwardly from the steps or teeth 112. In turn, the user may select the desired step 113A–F and 114A–F.

Outer lips 130A and 130B extend at an angle from the platform 102 to shield the pawls 122A and 122B from accidental contact and prevent inadvertent release. The angle at which outer lip 130A and 130B extend is sufficient to provide room to disengage the pawls 122A and 122B from the teeth 113A–D and 114A–D.

Figure 5:
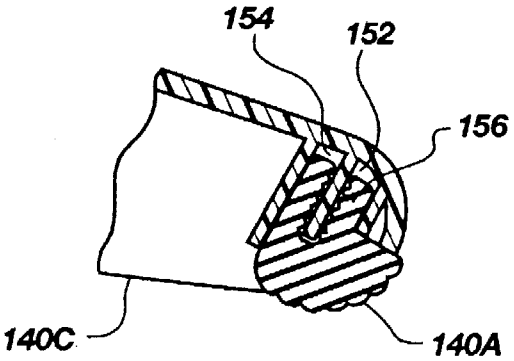
FIG. 5 is a cutaway detail of the support member of a preferred embodiment of the step bench.

The illustrated embodiment includes a segment of non-slip tread 140A and 140B adapted to the foot support 140C and 140D. As seen in FIG. 5, the foot support 140C may be formed with interior slots 152, 154. Tread segment 140A may be ribbed and is formed with one or more extensions 156 dimensioned to fit securely in the slot(s) 152 and 154.

Optionally but preferably, there is a cushion covering 157 affixed to the upper surface of the platform 102 in the recess 102E. The cushion covering 156 may be formed of a material such as closed-cell foam.

The step bench 100 can be formed of various materials or combinations of materials. However, for lightweightness, durability, low cost and ease of manufacture, it is highly desirable to make the bench of a comparatively hard plastic, for example by injection molding.

Figure 6:
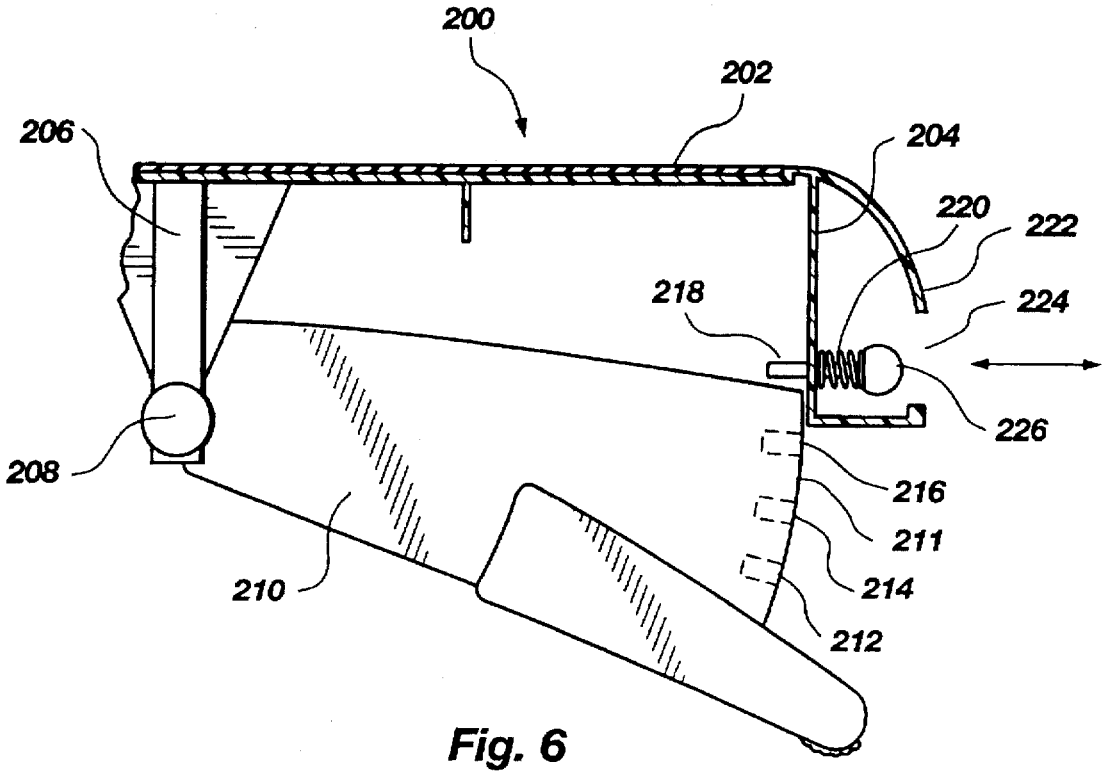
FIG. 6 is a partial, cross-sectional view of an alternate embodiment of the invention.

Referring now to FIG. 6, a partial cross section of an alternate step bench 200 is shown with a platform 202 for use in performing stepping exercises. A flange 204 extends downwardly from the platform 202. A central support 206 has a pivot 208 about which support member 210 rotates. A plurality of apertures 212, 214 and 216 are formed in the distal end 211 of the support member 210 to selectively register with pin 218. The pin is connected to the flange 204 and is urged by spring 220 toward the distal end 211. A covering 222 extends away from the platform 202 and over the pin 218 with an aperture 224 formed for the user to access knob 226 connected to the pin 218. As shown, the user may select four settings to vary the height of the bench 200 in a manner comparable to that discussed with respect to the bench of FIG. 1.

Figure 7:
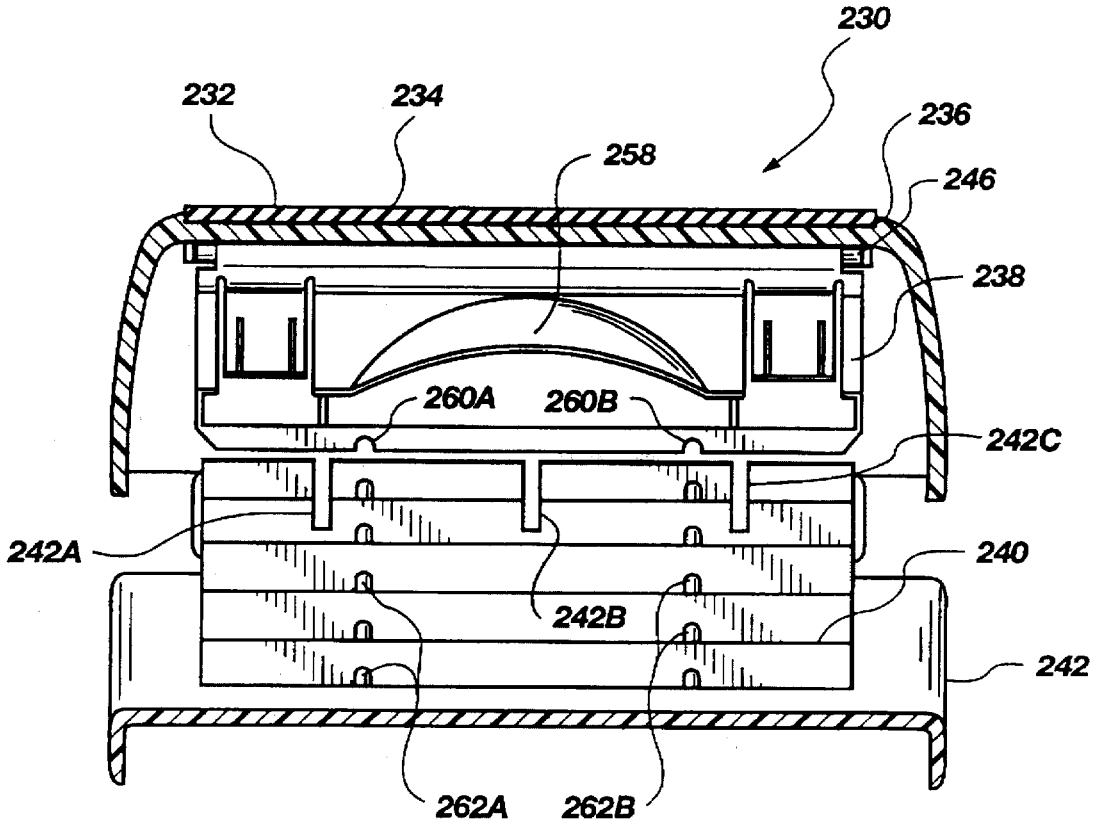
FIG. 7 is a partial cross sectional end view of a preferred embodiment of the invention.
Figure 8:
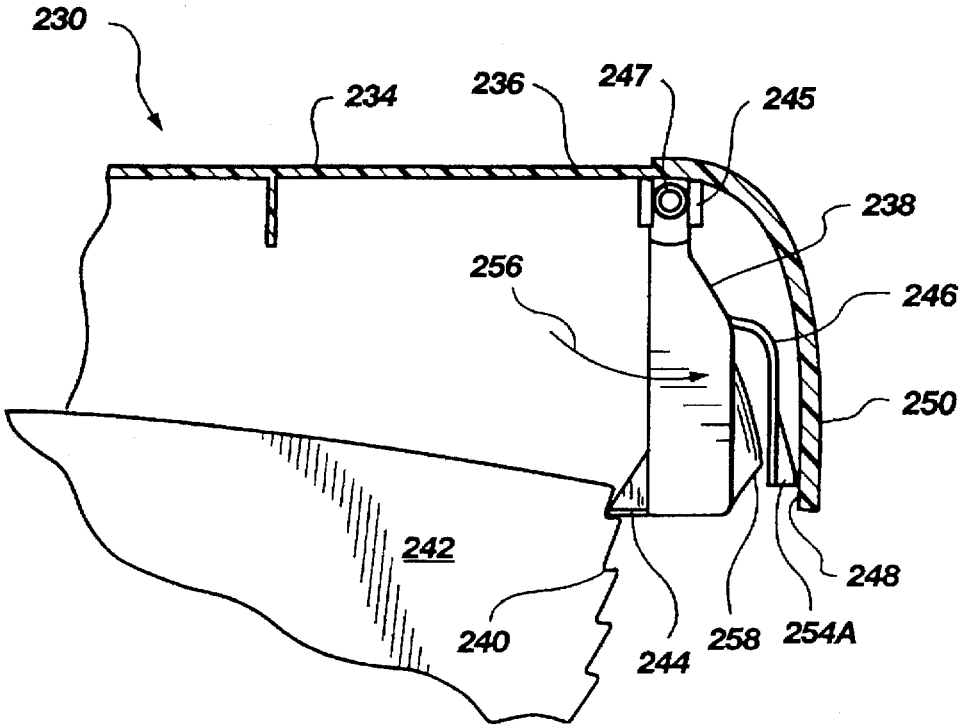
FIG. 8 is a partial cross sectional side view of the embodiment of FIG. 7.
Figure 9:
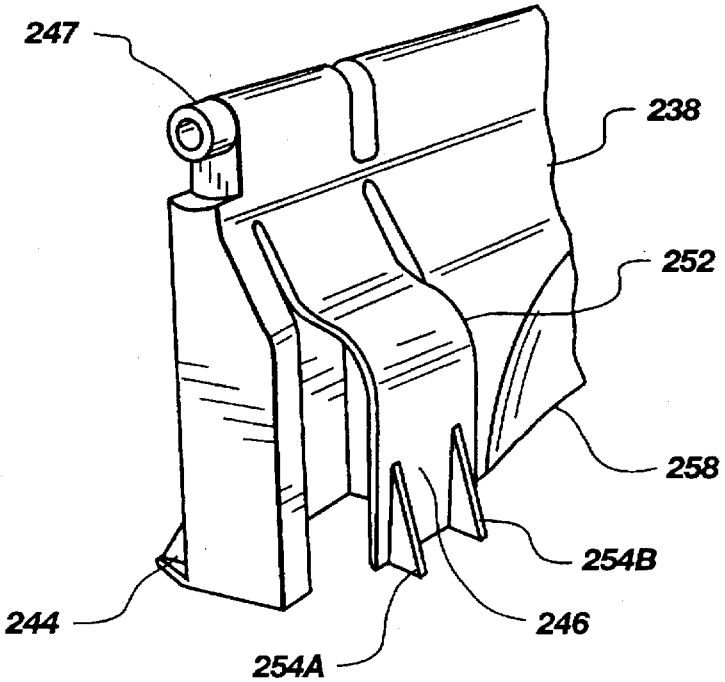
FIG. 9 is a partial perspective view of a pawl in FIGS. 7 and 8.

In an alternate and preferred configuration, the bench 230 shown in FIGS. 7, 8 and 9 has a platform 232 with a cushion 234 inserted into recess 236. The pawl 238 interconnects with selected steps 240 of the support member 242 with a lip 244. The pawl 238 is rotatably or pivotally attached to the underside of the platform 234 by a short snap fitting 245 sized to rotatably receive an axle member 247 formed as part of the pawl 238. The pawl 238 preferably has a leaf spring 246 formed therein to interconnect between the pawl 238 and inside surface 248 of lip 250. As best seen in FIG. 9, the spring 246 is unitarily formed from the pawl 238 with a lip 252 and two fingers 254A and 254B of the spring 246 which easily contact inside surface 248. As the pawl 238 rotates out 256, the spring compresses and urges the pawl 238 inward toward the selected step 240. The pawl 238 has a finger receiving portion 258 along with two slots 260A and 262B sized to coact with ridges 262A and 260B to secure the pawl 238 and support member 242 relative to each other. The support member 242 may have slots 242A, 242B and 242C to register with stiffeners under the platform 232.

In the arrangement of FIGS. 7, 8 and 9, an additional one or more springs similar to spring 246 may be provided in the pawl 238. The illustration of FIGS. 7–9 are partial cutaways and cross sections of one side. A second similar side is provided to present a complete bench.

Figure 10:
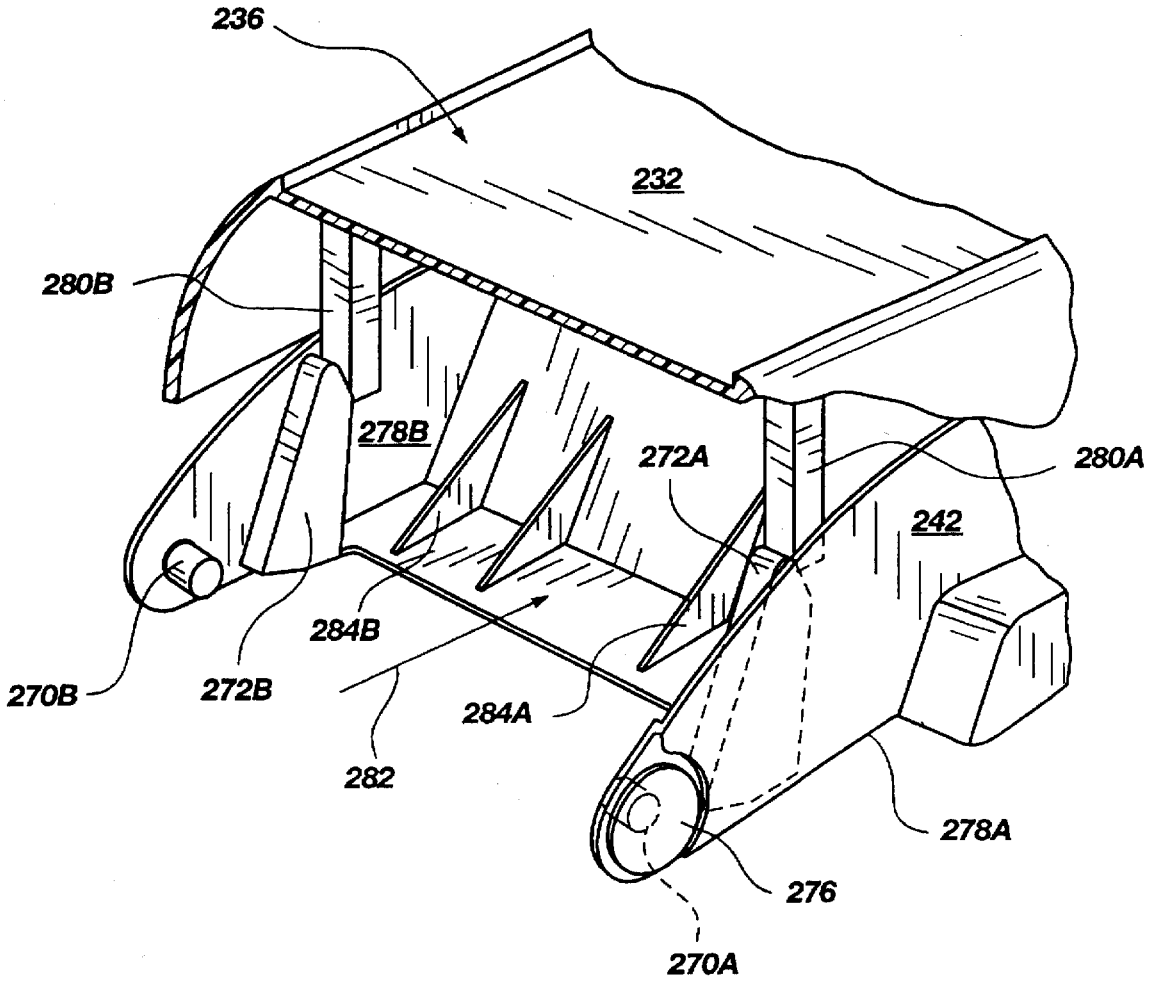
FIG. 10 is a partial cut away perspective view of the embodiment of FIG. 7.

FIG. 10 shows the support member 242 of the bench of FIGS. 7, 8 and 9. In FIG. 10, the support member 242 rotates about pins like pins 270A and 270B that extend into apertures (not shown) in support structure 242 not shown here for clarity. Two cams 272A and 272B are positioned interior the pivot 276 and the outer walls 278A and 278B of the support member 242. The cams 272A and 272B each move against cam posts 280A and 280B that are formed with and extend down from the platform 232. The cams 272A and 272B and the cam posts 280A and 280B guide the support member 242 and hold it securely in the event strong lateral forces 282 are applied. The support member 242 of FIG. 10 also has a plurality of lateral stiffeners 284A and 284B to reinforce and strengthen the member 242.

It should be understood that the above description of the embodiments illustrated is not intended to limit the scope of the claims which themselves set forth what is regarded as the invention.

What is claimed is:

1. A stepping bench comprising:

a platform having opposite ends;

support structure mechanically associated with said platform between said opposite ends;

a first support member having a proximal end rotatably attached to said support structure and a distal end moveable between a first position and a second position relative to said platform, said first support member having foot structure to contact a support surface;

first securing means mechanically associated with said platform proximate one end thereof for selectively securing said first support member in said first position and said second position;

a second support member having a proximal end rotatably attached to said support structure and a distal end moveable between a first position and a second position relative to said platform, said second support member having foot structure to contact a support surface;

second securing means mechanically associated with said platform proximate one end thereof for selectively securing said second support member in said first position and said second position;

first limiting means mechanically associated with said platform and said first support member to limit movement of said first support member outwardly from said platform; and second limiting means mechanically associated with said platform and said second support member to limit movement of said second support member outwardly from said platform.

2. The stepping bench of claim 1, further including a first flange and a second flange spaced apart from said first flange, said first flange and said second flange being connected to and extending downwardly from said platform.

3. The stepping bench of claim 2, wherein said first securing means includes a first mechanical member moveable relative to said first flange and first receiving structure associated with said distal end of said first support member to receive said first mechanical member.

4. The stepping bench of claim 3, wherein said first mechanical member is a first pawl connected to said first flange and wherein said first receiving structure is a plurality of ratchet steps sized and formed to sequentially connect with said first pawl in said first position and said second position.

5. The stepping bench of claim 4, wherein said second securing means includes a second mechanical member moveable relative to said second flange and second receiving structure associated with said distal end of said second support member to receive said second mechanical member.

6. The stepping bench of claim 5, wherein said second mechanical member is a second pawl connected to said second flange and said second receiving structure is a plurality of ratchet steps sized and formed to sequentially connect with said second pawl in the first position and the second position.

7. The stepping bench of claim 3, wherein said first mechanical member includes a pin and wherein said first receiving structure is a plurality of spaced apart apertures formed in said distal end.

8. The stepping bench of claim 7, wherein said pin has a knob on one end for grasping by the user and wherein said first mechanical member includes a spring interconnected between said pin and said first flange to urge said pin toward said spaced apart apertures.

9. The stepping bench of claim 4, wherein said first pawl has means associated therewith for operation by the user.

10. The stepping bench of claim 9, wherein said first mechanical member includes a spring to urge said first pawl toward said ratchet steps.

11. The stepping bench of claim 1, wherein said support structure includes a pivot member to which said first support member and said second support member are each rotatably secured.

12. The stepping bench of claim 3, further including a cover member connected to said platform and shaped to extend over said first mechanical member.

13. The stepping bench of claim 1, further including a cushioning mat positioned on the upward surface of said platform.

14. The stepping bench of claim 1, wherein said first securing means is a pawl rotatably secured to said platform proximate one end thereof.

15. The stepping bench of claim 14, wherein said first securing means includes a leaf spring associated with said pawl to urge said pawl toward first said support member.

16. The stepping bench of claim 1, wherein said first support member and said second support member are each moveable between at least four positions relative to said platform and wherein said first securing means and said second securing means each selectively secure said first support member and said second support member respectively in each of said at least four positions.

17. An adjustable height bench, comprising:

a platform having opposite ends;

a first pawl member moveably connected proximate to one of said opposite ends;

a second pawl member moveably connected proximate to the other of said opposite ends;

pivot means disposed below and connected to said platform between said opposite ends for pivoting a first ratchet member and a second ratchet member;

the first ratchet member disposed below said platform, said first ratchet member having foot structure to contact a support surface, a proximal end mounted to said pivot means and a distal end having a plurality of ratchet teeth thereon, for ratcheting engagement with said first pawl member;

the second ratchet member disposed below said platform, said second ratchet member having foot structure to contact a support surface, a proximal end mounted to said pivot means, and a distal end having a plurality of ratchet teeth for ratcheting engagement with said second pawl member;

first limiting means mechanically associated with said platform and said first ratchet member to limit rotational movement of said first ratchet member outwardly from said platform; and second limiting means mechanically associated with said platform and said second ratchet member to limit rotational movement of said second ratchet member outwardly from said platform.

18. The adjustable height bench of claim 17, wherein said first ratchet member and said second ratchet member each have a width comparable to or slightly less than the width of said platform.

19. The adjustable height bench of claim 17, wherein said platform has a upper surface and a mat formed of a cushioning material affixed to said upper surface.

20. The adjustable height bench of claim 17, further including a lip depending from said platform at both said opposite ends and covering said first and second pawl members, said lip extending outwardly from said platform to provide room to rotate said pawl members out of engagement with said ratchet teeth.

21. The adjustable height bench of claim 17, wherein said first pawl member is mounted to pivot about an axel, and wherein said second pawl member is mounted to pivot about an axle.

22. The adjustable height bench of claim 21, wherein said ratchet members further have foot members extending from said distal ends each having foot surfaces which contact the support surface.

23. The adjustable height bench of claim 22, wherein said foot members have a nonslip member applied on said foot surface.

24. The adjustable height bench of claim 17, wherein said first ratchet member and said second ratchet member are each configured with a semi-cylindrical surface having a series of ratchet grooves formed in the distal ends thereof.

25. The adjustable height bench of claim 17, wherein said distal ends of said first ratchet member and said second ratchet member further include a non-slip tread fixed thereto.

26. The adjustable height bench of claim 17, wherein said pivot means is a single pivot.

27. An adjustable height bench, comprising:

a platform having an upper surface and opposing ends;

a first pawl member pivotally mounted to said platform proximate one of said opposing ends;

a second pawl member pivotally mounted to said platform proximate the other of said opposing ends in facing orientation to said first pawl member; and first and second support members disposed below said platform and between said opposing ends, said first and second support members each having foot structure for contact with a support surface and each having respective proximal ends and respective distal ends, and said first and second support members being pivotally connected to rotate about a common axis at their respective said proximal ends, and said distal ends each having a semi-cylindrical surface with ratchet teeth disposed thereon, said ratchet teeth being engagable with said first and second pawl members.

28. The stepping bench of claim 1, wherein said first limiting means includes a first cam connected to said first support member and a first cam post connected to said platform and positioned for contact by said first cam.

29. The stepping bench of claim 28, wherein said second limiting means includes a second cam connected to said second support member and a second cam post connected to said platform and positioned for contact by said second cam.

30. A stepping bench comprising:

a platform having opposite ends;

a first flange and a second flange spaced apart from said first flange, said first flange and said second flange each being connected to and extending away from said platform;

support structure mechanically associated with said platform between said opposite ends;

a first support member having foot structure for contact with a support surface, a proximal end rotatably attached to said support structure and a distal end moveable between a first position and a second position relative to said platform;

first securing means mechanically associated with said platform proximate one end thereof for selectively securing said first support member in said first position and said second position, said first securing means including a first pawl connected to and moveable relative to said first flange and ratchet steps sized and formed in said distal end of said first support member to sequentially connect with said first pawl in said first position and said second position, said first pawl having handle means associated therewith for operation by a user;

a second support member having foot structure for contact with a support surface, a proximal end rotatably attached to said support structure and a distal end moveable between a first position and a second position relative to said platform; and second securing means mechanically associated with said platform proximate one end thereof for selectively securing said second support member in said first position and said second position, said second securing means including a second pawl connected to and moveable relative to said second flange and ratchet steps sized and formed in said distal end of said second support member to sequentially connect with said second pawl in the first position and the second position, said second pawl having handle means for operation by a user.

31. A stepping bench comprising:

a platform having opposite ends;

a first flange and a second flange spaced apart from said first flange, said first flange and said second flange each being connected to and extending downwardly from said platform;

support structure mechanically associated with said platform between said opposite ends;

a first support member having foot structure for contact with a support surface, a proximal end rotatably attached to said support structure and a distal end moveable between a first position and a second position relative to said platform;

first securing means mechanically associated with said platform proximate one end thereof for selectively securing said first support member in said first position and said second position, said first securing means including a first pawl connected to and moveable relative to said first flange and ratchet steps sized and formed in said distal end of said first support member to sequentially connect with said first pawl in said first position and said second position;

a second support member having foot structure for contact with a support surface, a proximal end rotatably attached to said support structure and a distal end moveable between a first position and a second position relative to said platform; and second securing means mechanically associated with said platform proximate one end thereof for selectively securing said second support member in said first position and said second position, said second securing means including a second pawl connected to and moveable relative to said second flange and ratchet steps sized and formed in said distal end of said second support member to sequentially connect with said second pawl in the first position and the second position;

a first spring positioned between said first pawl and said first flange to urge said first pawl toward said ratchet steps of said first support member; and a second spring positioned between said second pawl and said second flange to urge said second pawl toward said ratchet steps of said second support member.

32. An adjustable height bench, comprising:

a platform having opposite ends;

a first pawl member adapted proximate one of said opposite ends;

a second pawl member adapted proximate the other of said opposite ends; pivot structure associated with said platform between said opposite ends;

a first ratchet member disposed below said platform, said first ratchet member having foot structure for contact with a support surface, a proximal end pivotally mounted to said pivot structure and a distal end having ratchet teeth thereon for ratcheting engagement with said first pawl member;

a second ratchet member disposed below said platform, said second ratchet member having foot structure for contact with a support surface, a proximal end pivotally mounted to said pivot structure, and a distal end having ratchet teeth for ratcheting engagement with said second pawl member;

a lip depending from said platform at both said opposing ends to cover said first pawl member and said second pawl member, said lip extending outwardly from said platform and configured to provide room to rotate said first pawl member and said second pawl member out of engagement with the respective said ratchet teeth of said first ratchet member and said second ratchet member.

33. An adjustable height bench, comprising:

a platform having opposite ends;

a first pawl member adapted proximate one of said opposite ends;

a second pawl member adapted proximate the other of said opposite ends;

pivot structure associated with said platform between said opposite ends;

a first ratchet member disposed below said platform, said first ratchet member having foot structure for contact with a support surface, a proximal end pivotally mounted to said pivot structure and a distal end configured as a semi-cylindrical surface with ratchet teeth formed therein for ratcheting engagement with said first pawl member; and a second ratchet member disposed below said platform, said second ratchet member having foot structure for contact with a support surface, a proximal end pivotally mounted to said pivot structure, and a distal end configured as a semi-cylindrical surface with ratchet teeth formed therein for ratcheting engagement with said second pawl member.

34. An adjustable height step exercise bench for use by a user for performing step exercises, said step exercising bench comprising:

a platform having opposite ends;

a first pawl member adapted proximate one of said opposite ends;

a second pawl member adapted proximate the other of said opposite ends;

pivot structure associated with said platform between said opposite ends;

a first ratchet member disposed below said platform, said first ratchet member having foot structure to contact a support surface, a proximal end pivotally mounted to said pivot structure and a distal end having a surface facing away from said pivot structure with ratchet teeth formed in said surface for engagement with said first pawl; and a second ratchet member disposed below said platform, said second ratchet member having foot structure to contact a support surface, a proximal end pivotally mounted to said pivot structure and a distal end having a surface facing away from said pivot structure with ratchet teeth formed in said surface for engagement with said second pawl.

* * * * *